US007666689B2

(12) United States Patent
Codding et al.

(10) Patent No.: US 7,666,689 B2
(45) Date of Patent: Feb. 23, 2010

(54) METHOD TO REMOVE CIRCUIT PATTERNS FROM A WAFER

(75) Inventors: Steven R. Codding, Underhill Center, VT (US); David Domina, Cambridge, VT (US); James L. Hardy, Essex Junction, VT (US); Timothy Krywanczyk, Essex Junction, VT (US)

(73) Assignee: International Business Machines Corporation, Armonk, NY (US)

( * ) Notice: Subject to any disclaimer, the term of this patent is extended or adjusted under 35 U.S.C. 154(b) by 31 days.

(21) Appl. No.: 11/609,573

(22) Filed: Dec. 12, 2006

(65) Prior Publication Data

US 2008/0139088 A1 Jun. 12, 2008

(51) Int. Cl.
*H01L 21/00* (2006.01)

(52) U.S. Cl. ..... 438/4; 451/38; 257/E21.239

(58) Field of Classification Search ..... 438/689, 438/691, 471, 4, 690; 216/93; 257/E21.214, 257/E21.219, E21.239
See application file for complete search history.

(56) References Cited

U.S. PATENT DOCUMENTS

| | | | | |
|---|---|---|---|---|
| 6,406,923 | B1 * | 6/2002 | Inoue et al. | 438/4 |
| 6,451,696 | B1 * | 9/2002 | Hara et al. | 438/691 |
| 6,673,522 | B2 * | 1/2004 | Kim et al. | 430/321 |
| 6,852,241 | B2 * | 2/2005 | Hart et al. | 216/27 |
| 7,083,824 | B2 | 8/2006 | Stankowski et al. | |
| 2002/0081243 | A1 * | 6/2002 | He | 422/177 |
| 2003/0121511 | A1 * | 7/2003 | Hashimura et al. | 125/2 |

FOREIGN PATENT DOCUMENTS

| | | | | |
|---|---|---|---|---|
| JP | 61159371 | A | | 7/1986 |
| JP | 8279514 | A | | 10/1996 |
| JP | 10308398 | A | | 11/1998 |
| JP | 2001237201 | A | | 8/2001 |
| JP | 2003145426 | A | * | 5/2003 |

* cited by examiner

*Primary Examiner*—Zandra Smith
*Assistant Examiner*—Shaka Scarlett
(74) *Attorney, Agent, or Firm*—Gibb I.P. Law Firm, LLC; Richard M. Kotulak, Esq.

(57) ABSTRACT

A method holds wafers that contain patterned structures using a particle blasting tool. Next, the method directs particles at the patterned structures, such that the particles contact the patterned structures with a predetermined velocity and remove the patterned structures. This process of directing the particles at the wafer is controlled to stop directing the particles when substantially all of the patterned structures are removed from the wafer. This process also comprises selecting the particles to have a size equal to or less than 3 microns. For example, the particles can comprise aluminum oxide, silicon oxide, cerium, and/or a plastic. By maintaining the particle size equal to 3 microns or less, the blasting produces a substantially smooth wafer surface, thereby omitting the need for subsequent wafer polishing. Further, the wafers produced by such processing do not exhibit the highly stress lattice and fragile nature of wafers processed by wet processing.

4 Claims, 1 Drawing Sheet

METHOD TO REMOVE CIRCUIT PATTERNS FROM A WAFER

BACKGROUND

1. Field of the Invention

The embodiments of the invention generally relate to reuse of previously processed wafers, and, more particularly, to an improved process that uses particle application to remove patterned structures from wafers without removing significant amounts of silicon from the wafers.

2. Description of the Related Art

Large amounts of money are spent every year on silicon wafers that are used to monitor manufacturing operations. To reduce such costs, the monitoring wafers can be sold, recycle, or reclaimed. One issue is that the circuit patterns on the wafers (be it product or monitor wafers) is proprietary and should not be sent out to vendors for rework or sale.

One solution to removing such patterns is a prolonged exposure in a wet bath (such as HF, $HNO_3$, $H_2O_2$, S, P, HCL, etc.). While this wet bath process does indeed remove all films, it often causes significant bulk silicon removal as well, since the materials being removed are similar in characteristics to silicon. Further, the non-uniform film coverage creates non-uniform etch spots. The resulting wafer product of such wet bath processing is a highly stress lattice and is fragile wafer after a rework cycle. Also, the costs of such processing are increased by the dedicated wet tank that is needed, the cost of the chemicals that are needed, and the need to dispose of the used chemicals.

Another method for removing patterned structures performs a layer by layer removal process. In such a process, each layer is removed (one at a time) using specific wet chemistry combined with dry etching. While such processing minimizes silicon substrate damage, it has high costs including the requirement for dedicated tools. Further, such processing is time and labor intensive and involves lapping and grinding.

In addition, such layer by layer processing can cause lattice damage causing wafers to break and requires post-processing polishing.

SUMMARY

In view of the foregoing, an embodiment of the invention provides a method of removing patterned structures from silicon wafers. Such wafers are often used as manufacturing control wafers and are not production wafers that contain usable chips, production wafers are divided into wafer chips. The method holds such manufacturing control wafers that contain patterned structures using a particle blasting tool.

The method directs particles at the patterned structures, such that the particles contact the patterned structures with a predetermined velocity and remove the patterned structures. The particles are directed toward the wafer using some high velocity device, such as a compressed air stream. This process of directing the particles at the wafer is controlled to stop directing the particles when substantially all of the patterned structures are removed from the wafer. After the directing of the particles is stopped, the wafer is immediately available as a recycled wafer upon which structures and layers can be formed without additional polishing, lapping, or grinding. Even if some structures or partial structures remain, such structures are random and do not disclose any of the previously existing patterns.

This process also comprises selecting the particles to have a size equal to or less than 3 microns. For example, the particles can comprise aluminum oxide, silicon oxide, cerium, and/or a plastic. By maintaining the particle size equal to 3 microns or less, the blasting produces a substantially smooth wafer surface, thereby omitting the need for subsequent wafer polishing. Further, the wafers produced by such processing do not exhibit the highly stress lattice and fragile nature of wafers processed by wet processing, as discussed above.

These and other aspects of the embodiments of the invention will be better appreciated and understood when considered in conjunction with the following description and the accompanying drawings. It should be understood, however, that the following descriptions, while indicating preferred embodiments of the invention and numerous specific details thereof, are given by way of illustration and not of limitation. Many changes and modifications may be made within the scope of the embodiments of the invention without departing from the spirit thereof, and the embodiments of the invention include all such modifications.

BRIEF DESCRIPTION OF THE DRAWINGS

The embodiments of the invention will be better understood from the following detailed description with reference to the drawings, in which.

DETAILED DESCRIPTION OF PREFERRED EMBODIMENTS

Figure 1:
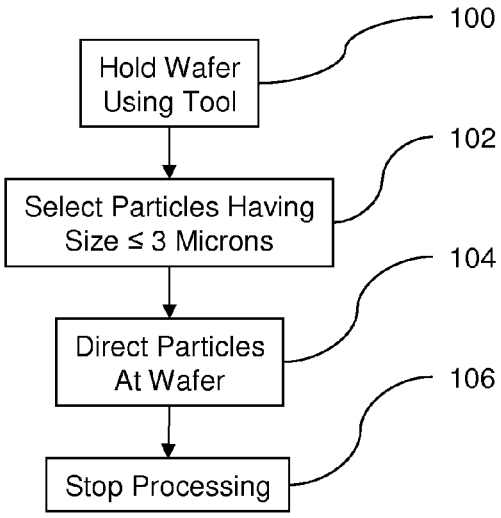
FIG. 1 is a flow diagram illustrating an embodiment of the invention.

The embodiments of the invention and the various features and advantageous details thereof are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the embodiments of the invention. The examples used herein are intended merely to facilitate an understanding of ways in which the embodiments of the invention may be practiced and to further enable those of skill in the art to practice the embodiments of the invention. Accordingly, the examples should not be construed as limiting the scope of the embodiments of the invention.

An embodiment of the invention provides a method of removing patterned structures from silicon wafers. The method holds such wafers that contain patterned structures using a particle blasting tool as shown by item 100 in FIG. 1. Such a wafer was previously used as a manufacturing control wafer and was not divided into wafer chips after the previous processing.

Before particles are blasted at the wafer, the method selects the particles to have a size equal to or less than 3 microns (item 102). For example, the particles can comprise aluminum oxide, silicon oxide, cerium, and/or a plastic. By maintaining the particle size equal to 3 microns or less, the blasting produces a substantially smooth wafer surface, thereby omitting the need for subsequent wafer polishing. Further, the wafers produced by such processing do not exhibit the highly stressed lattice and fragile nature of wafers processed by wet processing, as discussed above.

The method directs particles toward the patterned structures (item 104), such that the particles contact (strike, blast, etc.) the patterned structures with a predetermined velocity sufficient to remove the patterned structures. The particles are directed toward the wafer using some high velocity device, such as a compressed air stream, to blast the wafer.

This process of directing the particles at the wafer is controlled to stop directing the particles when substantially all of the patterned structures are removed from the wafer (item 106). After the directing of said particles is stopped, the wafer is immediately available as a recycled wafer upon which structures and layers can be formed without additional polishing. Even if some structures or partial structures remain, such structures are random and do not disclose any of the previously existing patterns.

Figure 2:
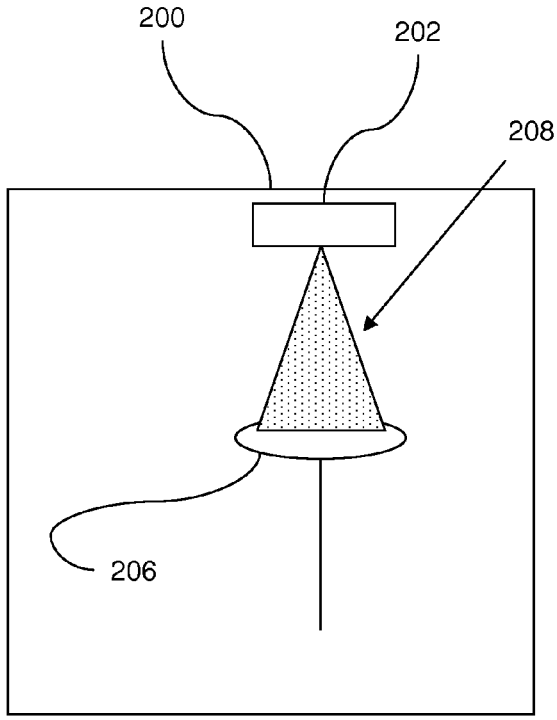
FIG. 2 is a schematic diagram of a particle blasting tool.

FIG. 2 is a schematic diagram of a particle blasting tool 200 which includes a chuck 206 for holding a wafer 206. A particle stream 208 is generated by a pressurized device 202 such that the particle stream 208 is directed with high velocity toward the wafer 206 so that the patterned structures thereon are removed.

Therefore, as discussed above, with embodiments herein, a particle blast is applied to the surface of the wafer with the pattern. The particles are applied under pressure to the wafer surface removing the pattern and a small amount of silicon. The parameters of pressure, duration, etc. can be altered based on material to be removed and time requirements.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments of the invention have been described in terms of preferred embodiments, those skilled in the art will recognize that the embodiments of the invention can be practiced with modification within the spirit and scope of the appended claims.

What is claimed is:

1. A method of removing patterned structures from silicon wafers, said method comprising:

holding a wafer comprising patterned structures using a particle blasting tool;

directing particles at said patterned structures, such that said particles contact said patterned structures with a predetermined velocity and remove said patterned structures, wherein said directing of said particles further comprises selecting said particles to have a size equal to or less than 3 microns; and controlling said directing of said particles to stop directing said particles when substantially all of said patterned structures are removed from said wafer, wherein after said directing of said particles is stopped, said wafer is immediately available as a recycled wafer upon which structures and layers can be formed without additional polishing.

2. The method according to claim 1, wherein said particles comprise at least one of aluminum oxide, silicon oxide, cerium, and a plastic.

3. A method of removing patterned structures from silicon wafers, said method comprising:

holding a wafer comprising patterned structures using a particle blasting tool, wherein said wafer was previously used as a manufacturing control wafer and was not divided into wafer chips after previous processing;

directing particles at said patterned structures, such that said particles contact said patterned structures with a predetermined velocity and remove said patterned structures, wherein said directing of said particles further comprises selecting said particles to have a size equal to or less than 3 microns; and controlling said directing of said particles to stop directing said particles when substantially all of said patterned structures are removed from said wafer, wherein after said directing of said particles is stopped, said wafer is immediately available as a recycled wafer upon which structures and layers can be formed without additional polishing.

4. The method according to claim 3, wherein said particles comprise at least one of aluminum oxide, silicon oxide, cerium, and a plastic.

* * * * *